US008760445B2

(12) United States Patent
Shao et al.

(10) Patent No.: US 8,760,445 B2
(45) Date of Patent: Jun. 24, 2014

(54) METHOD OF CORRECTING BRIGHTNESS OF ELECTRONIC DISPLAY

(75) Inventors: Yin-liang Shao, Beijing (CN); Lei Yang, Beijing (CN); Li Guan, Beijing (CN)

(73) Assignee: Zhongqing Digital Equipment Co., Ltd., Shenzhen (CN)

( * ) Notice: Subject to any disclaimer, the term of this patent is extended or adjusted under 35 U.S.C. 154(b) by 650 days.

(21) Appl. No.: 13/002,046

(22) PCT Filed: Sep. 18, 2009

(86) PCT No.: PCT/CN2009/001045

§ 371 (c)(1), (2), (4) Date: Dec. 30, 2010

(87) PCT Pub. No.: WO2010/031252

PCT Pub. Date: Mar. 25, 2010

(65) Prior Publication Data

US 2011/0157115 A1 Jun. 30, 2011

(30) Foreign Application Priority Data

Sep. 19, 2008 (CN) ..... 2008 1 0222542

(51) Int. Cl.
*G09G 5/00* (2006.01)
*G09G 5/10* (2006.01)

(52) U.S. Cl.
USPC ..... 345/207

(58) Field of Classification Search
CPC combination set(s) only.
See application file for complete search history.

(56) References Cited

U.S. PATENT DOCUMENTS

| | | | | |
|---|---|---|---|---|
| 6,320,652 | B1 * | 11/2001 | Morimoto et al. | 356/124 |
| 6,459,425 | B1 * | 10/2002 | Holub et al. | 345/207 |
| 7,161,558 | B1 | 1/2007 | Eidem et al. | |
| 2003/0058202 | A1 * | 3/2003 | Evanicky et al. | 345/82 |
| 2005/0068291 | A1 | 3/2005 | Coley et al. | |
| 2008/0042045 | A1 * | 2/2008 | Miyazawa | 250/205 |
| 2008/0252629 | A1 * | 10/2008 | Chiang | 345/207 |

FOREIGN PATENT DOCUMENTS

| | | | |
|---|---|---|---|
| CN | 101076128 | A | 11/2007 |
| CN | 101097428 | A | 1/2008 |
| CN | 101202015 | A | 6/2008 |
| CN | 101377918 | A | 3/2009 |

* cited by examiner

*Primary Examiner* — Alexander S Beck
*Assistant Examiner* — K. Kiyabu
(74) *Attorney, Agent, or Firm* — Eagle IP Limited; Jacqueline C. Lui

(57) ABSTRACT

The present invention discloses a method of brightness correction for the electronic display, which consists of the following steps: take pictures of the electronic display; get the characteristic values of all the light-emitting components in the pictures; calculate the correction values of each light-emitting component with the characteristic values; correct the brightness of the display with the correction values. The present invention reduces the time cost of measuring the actual brightness values of the light-emitting components, and improves the efficiency of correcting the brightness uniformity of the electronic display.

19 Claims, 5 Drawing Sheets

METHOD OF CORRECTING BRIGHTNESS OF ELECTRONIC DISPLAY

FIELD OF THE INVENTION

The present invention relates to a correction method in the display field, and more particularly to a brightness correction method of the electronic display.

BACKGROUND OF THE INVENTION

The brightness nonuniformity of each pixel in an electronic display would seriously affect the quality of display. Monochrome display, for instance, the brightness nonuniformity of each pixel is reflected in the brightness discontinuity of the display. For a color display, the brightness nonuniformity is not only reflected in the discontinuity of the display, but also in the chromatic aberration.

In the prior art condition, because of the limit of the production technology, there are differences among the characteristic parameters of the light-emitting components which constitute a display. One pixel is consisted of one or more light-emitting components with characteristic parameter differences, which means the existence of the characteristic parameter differences among pixels, and leads to immediate operating characteristic differences and attenuation characteristic differences. The immediate operating characteristic differences would cause two problems, one is the nonuniformity among the light-emitting components of display which is just produced, the other is the brightness nonuniformity among display. The attenuation characteristic differences stated above refer to the differences of attenuation among light-emitting components used for a same period, which results in the brightness nonuniformity of the display.

In order to guarantee the display quality and solve the problem of brightness nonuniformity caused by the immediate operating characteristic differences, generally, there are two methods in the prior art condition. One is to aim at the display which does not require a high quality. The manufactures usually take the sifting method in which they reject the light-emitting components with bad brightness nonuniformity to achieve the purpose of brightness nonuniformity around the whole display. Although it could improve the brightness nonuniformity, the sifting process takes too much time and effort. The other method aims at the display which would realize a nice quality of display. The manufactures execute the spot-spot correction to each light-emitting component with brightness correction equipments after the electronic display manufacturing process. It costs too much by using the expensive correction equipments although it could achieve a good effect of correction. Furthermore, it would take too much time to finish the correction task of thousands of light-emitting components.

In order to solve the brightness nonuniformity problem caused by the attenuation characteristic differences, manufactures need to design a particular brightness correction device. However, the nonuniformity comes up only after a period of usage. This would lead to a predicament of returning to the factory for correction, while a field correction is a better choice. In the prior art condition, the field correction requires manual work by particular brightness correction devices. The manual correcting solution makes the correction engineer survey the display through a particular brightness correction device, so that the components with nonuniform brightness could be picked up, after that, the engineers execute the spot-spot correction work to light-emitting components by corresponding brightness controllers. This solution exhausts correction engineers, brings errors and inaccuracies into the results, for which the nice correction effects usually could not be achieved.

As stated above, in the prior art condition, the brightness correction of electronic display is performed by the way of spot-spot examination and correction on light-emitting components of the display. For a display with millions of light-emitting components, it will take dozens of hours to finish the correction if the examination of 10 pixels costs 1 second, therefore the whole process will take too much time and human resources.

After all, the prior art that has apparent disadvantages needs to be improved.

CONTENTS OF THE INVENTION

It is an object of the present invention to provide a method which could improve the speed of brightness correction of an electronic display by surveying the actual brightness of several light-emitting components.

The technical solution of the invention is as follows:

A method of correcting brightness of an electronic display that consists of plenty of schism light-emitting components, which contains steps as below:

A. Capture an imaging picture of the display. It contains steps A1 to A4 that do not need to be implemented in a particular order, and could be implemented repeatedly or at the same time.

A1. Fix the photographic distance between the display and imaging units.

A2. Fix the photographic brightness of the electronic display

A3. Focus on the imaging units.

A4. Fix the photographic parameters of the imaging units.

A5. Take one or more photos of the electronic display by the imaging units to get the imaging photo of the display.

B. Get the characteristic parameters of each light-emitting component in the imaging photo of the display. It contains steps as below:

B1. Fix the locations of each light-emitting component at the imaging photo

B2. Fix the imaging region of each light-emitting component at the imaging photo.

B3. Get the grey value of each pixel in the imaging region of each light-emitting component, and calculate the characteristic values of each light-emitting component imaging.

C. Calculate the correction value of each light-emitting component with the characteristic values of each light-emitting component.

D. Correct the brightness of each light-emitting component with the correction values.

According to step A1 of the method stated above it requires an angle less than 10° between the photograph region and the imaging unit.

According to step A1 of method stated above it requires an angle less than 5° between the photograph region and the imaging unit.

According to step A1 of method stated above it requires an angle less than 3° between the photograph region and the imaging unit.

According to the method stated above it makes one light-emitting component correspond to several pixels by implementing step A2 or step A4, or implementing two of them at the same time.

According to the method stated above it makes one light-emitting component correspond to at least 25 pixels by implementing step A2 or step A4, or implementing two of them at the same time.

According to the method stated above, it makes the saturated imaging pixels occupy not more than 50% of all the imaging pixels by implementing step A2 or step A4, or implementing two of them at the same time.

According to the method stated above, it makes the saturated imaging pixels occupy not more than 20% of all the imaging pixels by implementing step A2 or step A4, or implementing two of them at the same time.

According to step A3 of the method stated above, the method of focusing on the imaging unit is as follows:

A31. Find the center point of two adjacent pixels.

A32. Get the grey value of the center point

A33. Get the grey value of the midpoint of the connecting line between the two adjacent pixels A34. Ensure that the grey value of the center point is not larger than half of the value of any pixel stated above.

According to step A4 of the method stated above, the photograph parameters include: the aperture value, which determines the amount of light admitted into the sensors; the filter, which reduces the imaging saturation into the preset value; the shutter value, which is 50 to 100 times of the scanning period; ISO, which avoids the photograph with a high sensitivity; the focal length, which makes the area of electronic display occupy a quarter of the frame.

According to the method stated above, the step B1 includes steps as follows:

B11. Get the quantity of light-emitting components in the horizontal direction and vertical direction of the imaging photo;

B12. Find the location of any light-emitting component of the imaging photo.

B13. Search the next light-emitting component with the location of the first component stated above.

B14. Execute the step B13 iteratively until all the light-emitting components of the imaging photo have been located.

According to step B12 of the method stated above, it includes locating or finding the location of each light-emitting component of the imaging photo.

According to step B12 of the method stated above, it includes locating one light-emitting component of the imaging photo. The component is selected random in the upper left, lower left, upper right, or lower left corner.

According to step B12 of the method stated above, it includes a process of judging whether the light-emitting component is damaged or missing. If the component is damaged or missing, we need to determine an adjacent or subsequential component.

According to the method stated above, the step B2 includes steps as follows:

B21. Fix the imaging radius of each light-emitting component

B22. Fix the imaging region of each light-emitting component as a circle with the center being at the location of component and the radius being the imaging radius.

According to the method stated above, the step B3 includes steps as follows:

B31. Get the gray value of each pixel in the imaging region, including R, G, and B.

B32. Calculate the grey value of each pixel in the imaging region with the preset algorithm, and get the characteristic value of the light-emitting component.

According to the method stated above, the step C includes steps as follows:

C1. Calculate the actual brightness of light-emitting component with the characteristic value of imaging.

C2. Calculate the correction value of each light-emitting component with the actual brightness.

A method of correcting brightness of an electronic display that consists plenty of schism light-emitting components, which contains steps as below:

A01. Fix the distance between the display and the imaging unit.

Fix the brightness of the electronic display by photographing.

Focus on the imaging units.

Fix the photograph parameters of the imaging units.

The steps do not have a particular implementing order, and could be implemented repeatedly or at the same time. Take one or more photos of the electronic display by the imaging units to get the imaging picture of the display.

B01. Fix the quantity of light-emitting components in the horizontal direction and vertical direction of the imaging photo.

Find a light-emitting component as the first one in the upper left, lower left, upper right, or lower left corner.

Make the first component as the starting point, with which we could execute the search iteratively until all the light-emitting components have been located.

Determine the imaging region of each light-emitting component, and get the gray value of each pixel in the imaging region, according to which, we calculate the characteristic value of each light-emitting component.

C01. Calculate the correction value of each light-emitting component with the characteristic value of each component.

D01. Correct the brightness of the display with the correction value stated above.

A method of correcting brightness of an electronic display that contains plenty of schism light-emitting components, which consists of steps as below:

A02. Fix the distance between the display and the imaging unit.

Fix the brightness of the electronic display by photographing.

Focus on the imaging units.

Fix the photograph parameters of the imaging units.

The steps do not have a particular implementing order, and could be implemented repeatedly or at the same time. Take one or more photos of the electronic display by the imaging units to get the imaging picture of the display.

B02. Fix the quantity of light-emitting components in the horizontal direction and vertical direction of the imaging photo.

Find a light-emitting component as the first one in the upper left, lower left, upper right, or lower left corner. If any of the components at the four corners is damaged or missing, we need to determine an adjacent or subsequential component.

Make the first component as the starting point, with which we could execute the search iteratively until all the light-emitting components have been located.

Determine the imaging region of each light-emitting component, and get the gray value of each pixel in the imaging region, according to which, we calculate the characteristic value of each light-emitting component.

C02. Calculate the correction value of each light-emitting component with the characteristic value of each component.

D02. Correct the brightness of the display with the correction value stated above.

Compared with the prior art, the present invention provide a method and system of the brightness correction for an electronic display. We could get the characteristic values of several light-emitting components on the screen by taking a photograph of the display. Furthermore, we could get the actual brightness of several light-emitting components with the characteristic values stated above, and finish the brightness correction. This method reduces the time cost of surveying the brightness of light-emitting components and improves the efficiency of the correction for the brightness nonuniformity.

MODE OF CARRYING OUT THE INVENTION

Make a further description for the preferred embodiments of the invention with the figures.

Mode 1:

The method of correcting brightness of an electronic display stated above is to capture an imaging picture of the display by photographing, which contains steps as follows:

Step A: Fix the photographic distance between display and imaging units; fix the photographic brightness of the electronic display; focus on the imaging units; fix the photographic parameters of the imaging units. The steps do not need to be implemented in a particular order, and could be implemented repeatedly or at the same time.

Step B: Fix the locations of each light-emitting component at the imaging photo; fix the imaging region of each light-emitting component at the imaging photo; get the grey value of each pixel in the imaging region of each light-emitting component, and calculate the characteristic values of each light-emitting component imaging.

Step C: Calculate the actual brightness of light-emitting component with the functional relationship of characteristic value of imaging and the actual brightness; calculate the correction value of each light-emitting component with the actual brightness.

Step D: Correct the brightness of each light-emitting component with the correction values to achieve the goal of brightness correcting with high efficiency.

Figure 3:
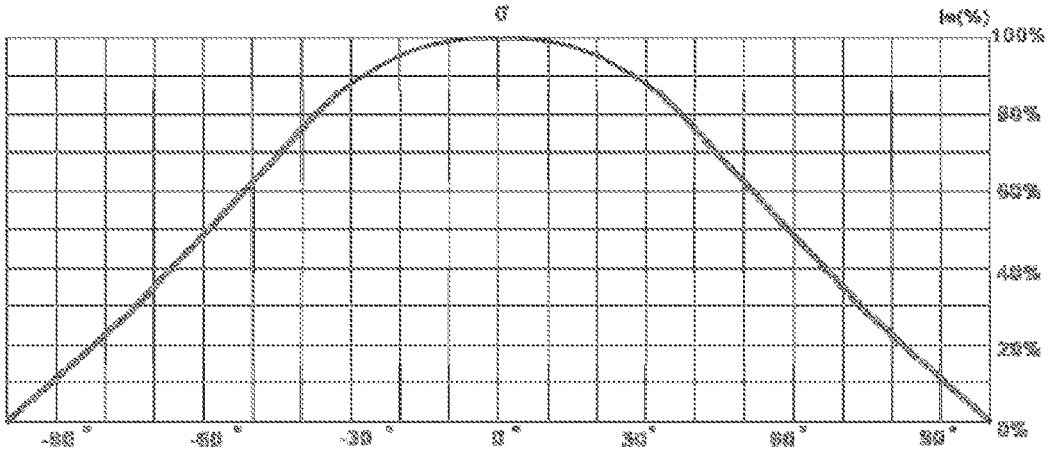
FIG. 3 is the light distribution diagram in all directions of a typical LED.

The correction method contains steps as bellow:

Step 101: Fix the photographic distance between the display and imaging units, which is defined by two factors:

The first factor is the light emitted by the light-emitting display has certain directions. FIG. 3 indicates a typical light distribution in all directions of a LED. In FIG. 3, the normal direction of light-emitting is signed. In the normal direction, the light intensity is 100%, and the percentage of light intensity in the direction which has an angle of deviation for the normal direction is defined as the measure. In the FIG. 3, when the angle of deviation is within 10°, the attenuation of light intensity is little; when the angle of deviation is between 10° to 30°, the attenuation of light intensity is between 5% to 10% per 10°; when the angle of deviation is larger than 30°, the attenuation of light intensity is larger than 10% per 10°. When we photograph the display with the imaging units, the angles between the light-emitting normal directions and the lens normal directions of different imaging units have deviation. In order to reduce the correction error caused by such deviation, the angle θ between the photographed region and the imaging units should be within some limit.

The second factor is that in order to enable the characteristic values to be more accurate, then a more accurate calculation of correction value, it requires that a single light-emitting component occupies several pixels. As we all know, electronic sensor such as CCD is composed of many tiny light-sensitive units which are arranged together in certain rules, and there are some clearances among the units. When the normal direction of light-emitting component is aligned exactly with the light-sensitive units, the sensor unit will capture much light. When the normal direction of light-emitting component is aligned exactly with the clearances, the light captured by the sensor would be much less than that above. When the imaging of light-emitting on the picture occupies only one or very few pixels, this effect will significantly affect the calculation of the calculation of the characteristic values. When the imaging of light-emitting on the picture occupies more pixels, this impact will be improved. As the preferred embodiment of this mode, we will get a more accurate characteristic value if a single light-emitting component occupies at least 25 pixels in the picture.

Based on the two factors, combined with the physical size of the electronic display, we can fix the distance between the display and the imaging units.

Step 102: Fix the photographic brightness of the electronic display. The brightness sensor of the imaging device has a brightness sensor range. When the brightness of the object being photographed is over the sensor's range, the sensor's output signal will not accurately reflect the brightness of the object. To make the imaging reflect the brightness of light-emitting devices, it requires ensuring the photographic brightness of the electronic display being within a proper range. On the other hand, because of the high level of brightness of the electronic light-emitting components, in order to meet the requirements above, the brightness of the display should be set to 10% or less of the maximum. While the photograph captured in this brightness level can not reflect the brightness differences of the conditions in which the display usually being used. Therefore, we need to raise the photographic brightness or adjust the photographic parameters, or both of them.

Taken together, adjust the photographic brightness or photographic parameters, or both of them, so that within all the light-emitting components in the imaging picture the saturated pixels occupy not greater than a certain range.

Step 103: Focus on the imaging units. At first, adjust the zoom device of the imaging device to ensure the photographed region covers the full imaging region. For the next, adjust the focusing device to ensure every light-emitting component be clear in the imaging region.

For example, adjust the lens focus ring to make every electronic component be clearly present in the frame. Then, if we continue to adjust the focus ring slightly, the clarity of each component in the frame declines, so the right status is the best one. The advantages of this approach are: first, to avoid the over-saturated condition of caused by the clearly-focusing; Secondly, the photos with lower clarity take a larger percentage of the pixels, which makes the captured data be more accurate.

For another example, the method of focusing on the imaging unit is: to fix the center point of two adjacent image pixels; get the gray value of the center point; get the gray value of the midpoint of the two adjacent pixels; ensure the gray value of the midpoint is not larger than half of the brightness of any one in the two points.

Step 104: Fix the photographic parameters of imaging units, including ISO, aperture, shutter value, focal length, filters and other parameters that directly affect the imaging results.

Aperture is a device that controls the light amount into the light-sensitive surface through the lens. The aperture value determines the light amount emitting into the imaging components. For example, the aperture value is expressed by the F value, adjust the aperture into a small one which means the maximum F value, which has two advantages: firstly, the small aperture could filter the "stray light" outside the electronic display, so that the captured brightness data is mainly the data of display. That is to minimize the effect caused by the light of outside. Secondly, the small aperture could prevent the over-saturated picture of a much too bright display.

In the condition of such parameters, the aperture is used to control the exposure amount. The set of aperture should avoid the over-exposure situation of the light-emitting components.

The shutter value is determined by the characteristics of the display. The display could be a scan display or a static display. In order to ensure that all the light-emitting components have an equal opportunity of emitting light, a appropriate shutter value is needed to be set. As the preferred embodiment of this mode, for a scan display, the shutter value should be not less than 50 times of the scan cycle; for a static display, the shutter value should be close to the display cycle, or the equivalent of display cycle.

For instance, when we set the shutter value, adjust the shutter value to 50 or 100 times of the scan cycle. In this way, a shutter of being long enough could avoid the situation of capturing a scan line by photographing, so that we could guarantee the accuracy of the photographing value of the display.

ISO sensitivity, such as a fixed value of 80 or 100, the digital camera sensor is active components, in which there is dark current and cut-off current in the normal mode. The part with noise disturbance would not be used, and the high ISO mode uses the part with lots of noise which are reflected in random colors. Thus, the photographing in the high ISO is not recommended.

The ISO value would affect the sensitivity of imaging devices. When the ISO value is set to be high, the imaging picture is prone to have noise points. The appearance of noise points may result that the imaging could not reflect the real brightness of the light-emitting components. Thus, the present invention requires the setting of ISO values should minimize the appearance of noise. As the preferred embodiment of this mode, the ISO of imaging device should be set to the minimum size.

Focal length, sets the imaging unit to photograph on the display. The photograph area covers ¼ of the entire electronic display area. After a large number of experiments, this way could avoid the row and column "border" phenomenon in the electronic display caused by the adjustment of camera.

Filter, when the imaging saturation value is greater than the preset value, we could use the filters to reduce the saturation so that the saturation values are set in the preset range.

For example, measure the field light automatically or manually and set an appropriate shutter value automatically or manually. By which there is not a phenomenon of over-exposure of the imaging for light-emitting component.

Step 105: take pictures of electronic display. According to the photographic parameters determined as above, take pictures of the electronic display and get the imaging pictures. As the preferred embodiment of this mode, we could take a few photos and get a few imaging pictures so that we could use the information of those pictures to get the correction value of the light-emitting components.

Step 106: Calculate the characteristic values of the light-emitting components. The steps is as follows:

Step 106A: Fix the locations of each light-emitting component in the imaging picture.

Step 106B: Fix the imaging region of each light-emitting component in the imaging picture.

Step 106C: Calculate the characteristic values of each light-emitting component according to the gray values of each pixel in the imaging region.

Step 106A stated above to fix the locations of each light-emitting component in the imaging picture consists of such steps as follows:

Step 106A1: Fix the number of light-emitting components in the horizontal and vertical directions.

Step 106A2: Specify or fix the location of a light-emitting component. The light-emitting component could be in the upper left corner, lower left, upper right or lower left of the component array. Judge the damaged or missing of component in the upper left, lower left, upper right, or lower left corner, and determine the component as the start point of the next step.

Step 106A3: Take the location of component stated above as the start point, search the next light-emitting component iteratively.

Step 106A4: Take the location of component searched in step 106A3 as a new start point, and search the next component iteratively.

Step 106A5: Search all the light-emitting components with the method stated in step 106A3 to step 106A4 until all the component locations have been determined.

Step 106B stated above to fix the imaging region of each light-emitting component in the imaging picture, which contains the steps as below:

Step 106B1: Fix the imaging radius of each light-emitting component. For example, the operator fixes the same or different imaging radius of each light-emitting component. In another way, we could fix the same of different imaging radiuses of all the components with the captured pictures.

Step 106B2: To determine the imaging regions of all the light-emitting components with the components in the imaging photos fixed in step 106A as the center, and the regions with the imaging radiuses as the imaging regions.

Step 106C stated above to calculate the characteristic values of each light-emitting component according to the gray values of each pixel in the imaging region which contains steps as below:

Step 106C1: Get the gray values of each component from the imaging region determined by the step 106B2, including R, G, and B.

Step 106C2: Calculate the gray values of all the pixels with the preset algorithm, and get the characteristic values of light-emitting components.

The algorithm stated in step 106C2 includes: getting the sum of gray values of all the pixels' R, G and B, getting the quadratic sum of gray values of all the pixels' R, G and B, getting the weighted average of gray values of all the pixels' R, G and B and so on.

Step 107: fix the actual brightness of all the light-emitting components. Because the gray values captured from the objects which have the same brightness are stable in the condition of consistent imaging parameters, the characteristic values captured from the gray values are also stable. Therefore, we could fully determine the relationship of imaging characteristic values under all kinds of setting parameters and the brightness of photographed objects. By which we could determine the actual brightness of all the light-emitting components.

Step 108: Calculate the correction value by determining the characteristic values of all the light-emitting components. After the determination of actual brightness in step 107, according to the requirement of the brightness correction for the display, we could fix the correction values of all the components.

For example, the actual brightness of a light-emitting component is $L_r$, the correction aims at $L_g$ we could fix the correction ratio as R:

$$R = \frac{L_g}{L_r} - 1 \qquad \text{Formula 1}$$

After calculating the ratio R through the formula 1, we could fix the correction value of light-emitting component by the definition of correction value in the actual system.

For example, if the correction value is defined as a brightness correction ratio represented by an 8 bit binary, in which 1 bit represents integer and 7 bit represents decimal. Take the rounding operation of ratio R calculated by the formula 1 as the correction value, the calculation method is presented as formula 2:

$$\text{correction value}=[R*128] \qquad \text{Formula 2:}$$

In formula 2, the symbol [ ] represents rounding operation.

Step 109: Correct the brightness of all the light-emitting components with the correction values. Apply all the correction values calculated in the step 108 in the control devices to correct the brightness of all the light-emitting components, so that the uniformity of brightness could be achieved.

Step 110: Judge whether the correction for the light-emitting components is over. If the correction is not completed, back to step 105; if the correction is completed, proceed to step 111.

Step 111: Complete the correction process stated above.

Mode 2:

Based on the mode 1, ensure that the setting of photographic distance makes the angle θ between the photographed region and imaging units be within 10°. That is, photographic distance=electronic display region being photographed/(2*tg (θ/2)), in which the angle θ is not larger than 10°.

Mode 3:

Based on the mode 1, ensure that the setting of photographic distance makes the angle θ between the photographed region and imaging units be within 5°. That is, photographic distance=electronic display region being photographed/(2*tg (θ/2)), in which the angle θ is not larger than 5°

Figure 5:
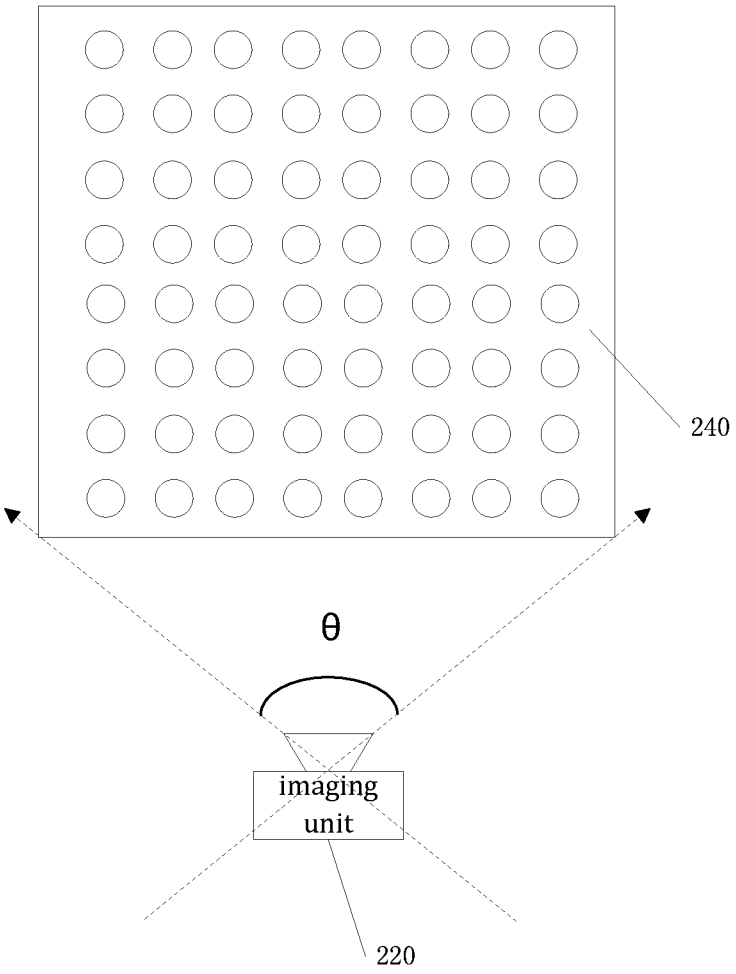
FIG. 5 is the schematic diagram of the visual field angle between the photographed region and the imaging region.

Best Mode 4:

Based on the mode 1, ensure that the setting of photographic distance makes the angle θ between the photographed region and imaging units be within 3°, so that the brightness could be adjusted to better effect. In FIG. 5, when the photographic region is the whole screen, the view angle θ is as showed in the figure. The angle θ would changes with the photographic region.

In the step 106A2, specify or fix the location of a component in the imaging picture. The component stated could be in the upper left corner, lower left, upper right or lower right position of the component array. When any component of these positions is damaged or missing, we specify the adjacent component, that is the second position of the missing one or the one in the subsequential position, and so on.

Mode 5:

Based on the mode 1, ensure that the setting of photographic brightness for the display makes the saturated imaging pixels do not occupy more than 50% of all the imaging pixels. In the other words, adjust the photographic brightness of the display, or adjust the photographic parameters of filter, aperture and so on, or adjust the photographic brightness and photographic parameters simultaneously to achieve the goal stated above. If the ratio is larger than 50%, continue to adjust the photographic brightness of the display, or adjust the photographic parameters of filter, or adjust the photographic brightness and photographic parameters simultaneously.

Mode 6:

Based on the mode 1, adjust the photographic brightness of the display, or adjust the photographic parameters of filter, aperture and so on, or adjust the photographic brightness and photographic parameters simultaneously to ensure that the saturated imaging pixels do not occupy more than 20% of all the imaging pixels. Thus, when the proportion is not larger than 20%, the imaging of the component could reflect the brightness of stated light-emitting components.

The beneficial effects of the above modes is: the present invention provides an electronic display brightness correction method to measure and get more than one light-emitting component correction value, which has a better speed, and reduces the error of correction by human factors that improve the accuracy of the correction.

Figure 1:
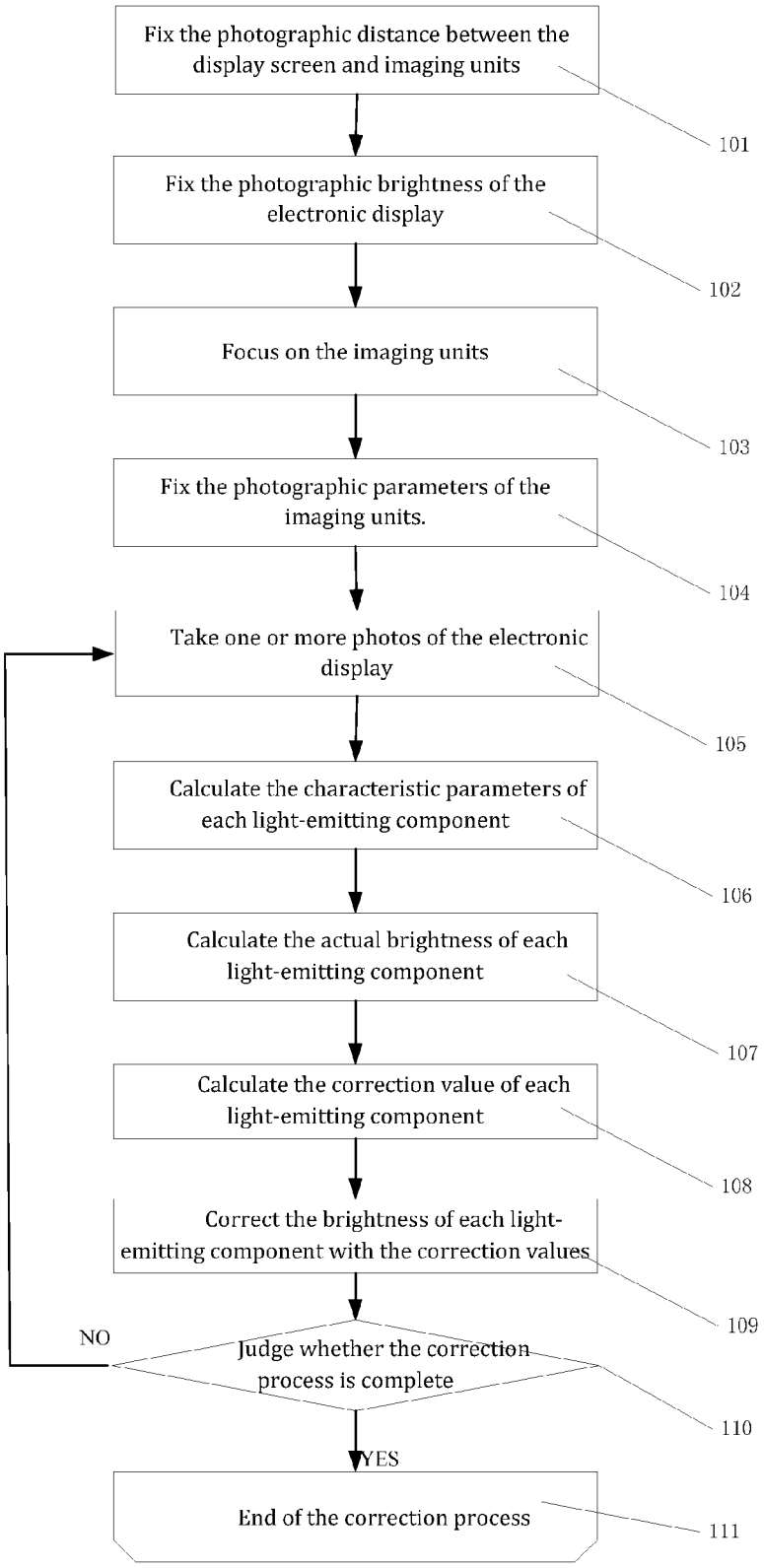
FIG. 1 is the flow diagram of the brightness correction method of electronic display.
Figure 2A:
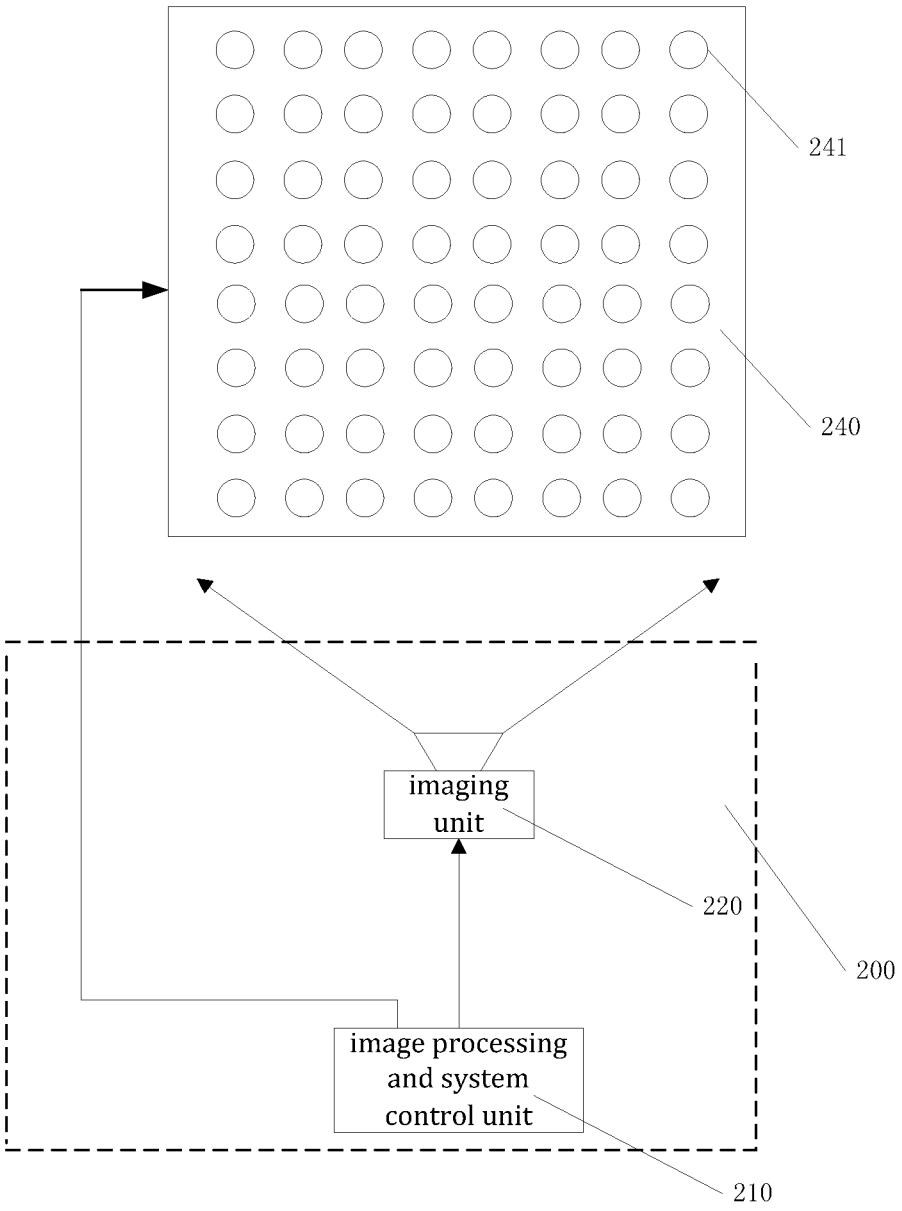
FIG. 2A is the structure diagram of the first brightness correction system.

Mode 7:

The disclosed brightness correction system 200 in present invention is as shown in FIG. 2. The described electronic display brightness correction system 200 includes the imaging unit 220 and image processing and system control unit 210 which is used to photograph for the display 240. The electronic display 240 includes a number of light-emitting components 241; the image processing and system control unit 210 captures pictures from imaging unit 220; image processing and system control unit 210 calculates the correction values of all the light-emitting components according to the pictures, and transmit the correction values to the display 240.

In the prior art, some displays have the function of brightness correction for the light-emitting components just with the correction values. Thus, the brightness correction system 200 in the present invention has the brightness correction function only by using the correction values of the light-emitting components.

The brightness correction system 200 showed in FIG. 2 also includes brightness correction units; the image processing and system control unit 210 transmits all the correction values to the brightness correction units; the brightness correction units correct the brightness of the components according to the correction values.

The components 241 set in the display 240 could be LED lights or any kind of light-emitting components.

The image processing and system control unit 210 is connected with the brightness correction units by wire, cable or fiber optic.

The imaging unit 220 is used to image the display 240. It includes high-resolution sensor, such as CCD devices, and aperture, shutter and sensitivity processing module which are usually used in normal imaging units. The sensitivity is ISO (International Standards Organization) value. The imaging unit 220 could set the aperture value, shutter value and the required imaging parameter of the ISO processing module.

Figure 4:
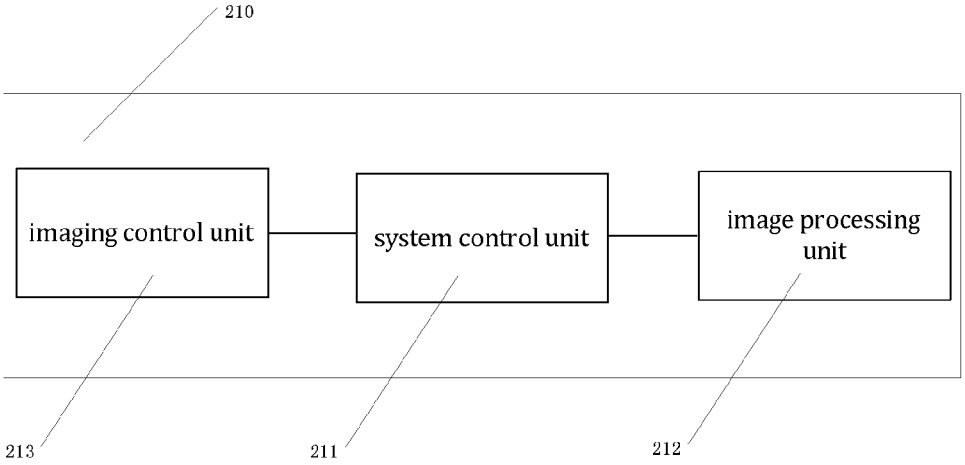
FIG. 4 is the functional structure diagram of image processing and system controlling unit of the present invention.

The image processing and system control unit 210 includes system control module 211 and picture processing module 212 as shown in FIG. 4. The picture processing module 212 is used to calculate the correction values of all the light-emitting components according to the photos captured by the imaging unit 220. The system control module 211 is used to control the operation of the brightness correction system, and transmit the correction values of the components to the display 240.

The image processing and system control unit 210 could also includes imaging control module 213, the imaging control module 213 is connected to the imaging unit 220, which are used to control the aperture value, shutter value and the required imaging parameter of the ISO processing module. The function of imaging control module 213 is same with the function of controlling the aperture value, shutter value and ISO processing control module in the imaging unit 220. When the setting of aperture value, shutter value and ISO processing module has been known, if the imaging control module 213 implements the settings under the control of system control module 211, we will get the effect of a more convenient operation.

The system control module 211, imaging processing module 212 and imaging control module 213 of the image processing and system control unit 210 could be implemented by software and could be integrated in one software.

The imaging unit 220 and the image processing and system control unit 210 have a direct physical connection or transmit pictures by removable storage devices such as USB, etc.

The beneficial effects of this mode are: the brightness correction system of electronic display uses low-cost devices to measure the light-emitting characteristic of all the light-emitting components. The system could finish the correction process quickly which improves the correction efficiency and reduce the cost of brightness correction system for electronic display.

Figure 2B:
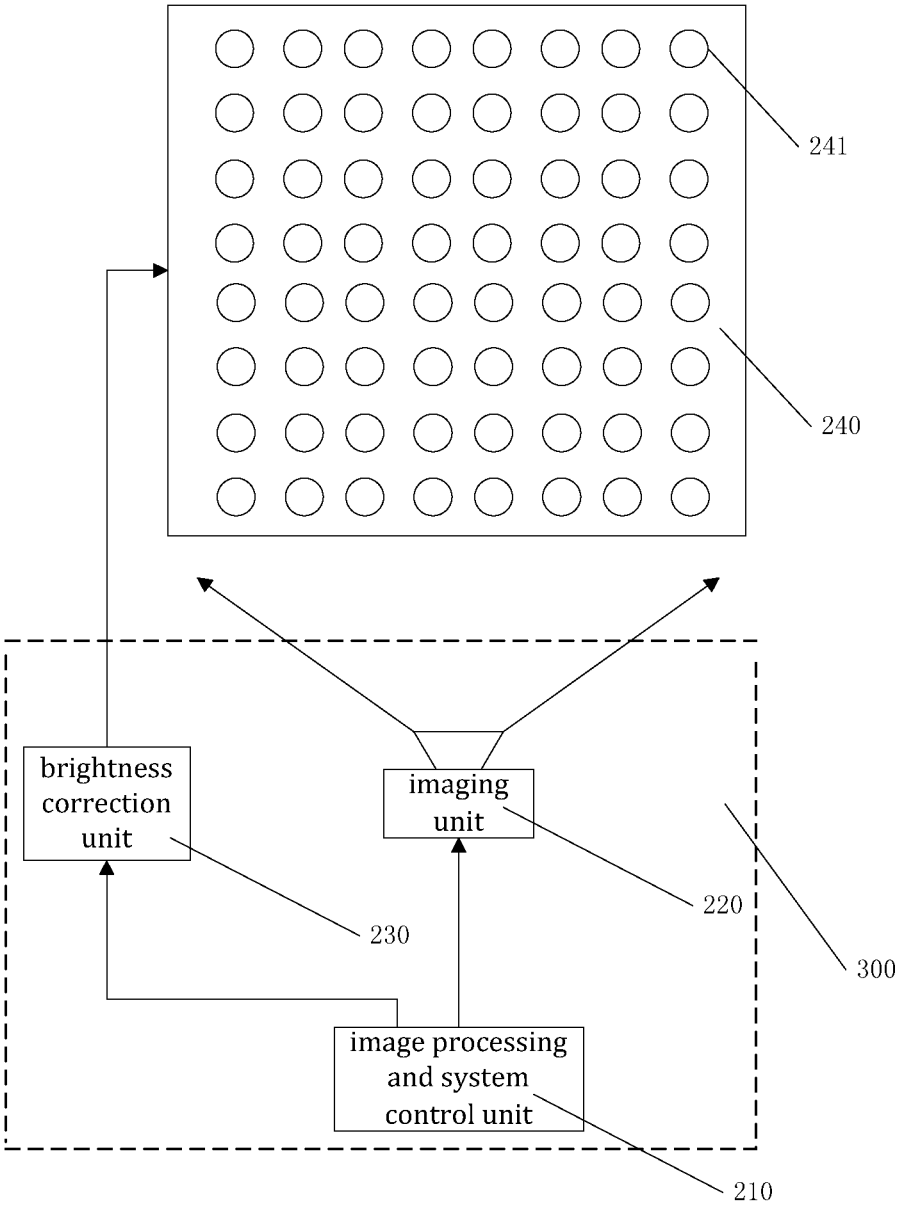
FIG. 2B is the structure diagram of the second brightness correction system.

Mode 8:

In the prior art, within the situation that the electronic display could not process the brightness correction according to the correction value of light-emitting components, the present invention provides an electronic system. As shown in FIG. 2B, it consists of display 240 and brightness correction system 300. The brightness correction system 300 consists of imaging unit 220 and the image processing and system control unit 210. The imaging unit 220 is used to take pictures for the display 240 which contains plenty of light-emitting components. The image processing and system control unit 210 captures imaging photos from the imaging unit 220, and calculates the correction value of all the light-emitting components and transmits the correction values to the electronic display, which is used to correct the brightness of components.

The electronic display system also includes brightness correction unit 230; the image processing and system control unit 210 transmits all the correction values to brightness correction unit 230; the brightness correction unit 230 corrects the brightness of light-emitting components with the correction values.

The image processing module is used to calculate the correction value of all the light-emitting components in the imaging picture; the system control module is used to control the operation of the brightness correction system and transmit the correction values to the display 240.

The image processing and system control unit 210 and the brightness correction unit 230 could be connected by the cable or fiber optic according to the distance of them.

The light-emitting components 240 set in the display 240 could be LED lights or any kind of light-emitting components.

The imaging unit 220 is used to image the display 240, which includes high-resolution sensor, such as CCD devices and aperture, shutter and ISO sensitivity processing module which are usually used in normal imaging units. The sensitivity is ISO (International Standards Organization) value. The imaging unit 220 could set the aperture value, shutter value and the required imaging parameter of the ISO processing module.

The image processing and system control unit 210 includes system control module 211 and picture processing module 212 as shown in FIG. 4. The picture processing module 212 is used to calculate the correction values of all the light-emitting components according to the photos captured by the imaging unit 220. The system control module 211 is used to control the operation of the brightness correction system, and transmit the correction values of the components to the display 240.

The image processing and system control unit 210 could also includes imaging control module 213, the imaging control module 213 is connected to the imaging unit 220, which are used to control the aperture value, shutter value and the required imaging parameter of the ISO processing module. The function of imaging control module 213 is same with the function of controlling the aperture value, shutter value and ISO processing control module in the imaging unit 220. When the setting of aperture value, shutter value and ISO processing module has been known, if the imaging control module 213 implements the settings under the control of system control module 211, we will get the effect of a more convenient operation.

The system control module 211, imaging processing module 212 and imaging control module 213 of the image processing and system control unit 210 could be implemented by software and could be integrated in one software.

The imaging unit 220 and the image processing and system control unit 210 have a direct physical connection or transmit pictures by removable storage devices such as USB, etc.

The beneficial effects of this mode are: the brightness correction system of electronic display uses low-cost devices to measure the light-emitting characteristic of all the light-emitting components. The system could finish the correction process quickly which improves the correction efficiency and reduce the cost of brightness correction system for electronic display.

Mode 9:

A method of brightness correction for the electronic display, which consists of the following steps:

A01. Fix the distance between the display and the imaging unit.

Fix the brightness of the electronic display by photographing.

Focus on the imaging units.

Fix the photograph parameters of the imaging units.

The steps do not have a particular implementing order, and could be implemented repeatedly or at the same time. Take one or more photos of the electronic display by the imaging units to get the imaging picture of the display.

B01. Fix the quantity of light-emitting components in the horizontal direction and vertical direction of the imaging photo.

Find a light-emitting component as the first one in the upper left, lower left, upper right or lower left corner.

Make the first component as the starting point, with which we could execute the search iteratively until all the light-emitting components have been located.

Determine the imaging region of each light-emitting component, and get the gray value of each pixel in the imaging region, according to which, we calculate the characteristic value of each light-emitting component.

C01. Calculate the correction value of each light-emitting component with the characteristic value of each component.

D01. Correct the brightness of the display with the correction values stated above.

The mode stated above could combine with mode 1 to 5, to achieve a better correction effect, which would not be described here.

Mode 10:

A method of correcting brightness of an electronic display that contains plenty of schism light-emitting components, which consists of steps as below:

A02. Fix the distance between the display and the imaging unit.

Fix the brightness of the electronic display by photographing.

Focus on the imaging units.

Fix the photograph parameters of the imaging units.

The steps do not have a particular implementing order, and could be implemented repeatedly or at the same time. Take one or more photos of the electronic display by the imaging units to get the imaging picture of the display.

B02. Fix the quantity of light-emitting components in the horizontal direction and vertical direction of the imaging photo.

Find a light-emitting component as the first one in the upper left, lower left, upper right or lower left corner. If any of the components at the four corners is damaged or missing, we need to determine an adjacent or subsequential component.

Make the first component as the starting point, with which we could execute the search iteratively until all the light-emitting components have been located.

Determine the imaging region of each light-emitting component, and get the gray value of each pixel in the imaging region, according to which, we calculate the characteristic value of each light-emitting component.

C02. Calculate the correction value of each light-emitting component with the characteristic value of each component.

D02. Correct the brightness of the display with the correction value stated above.

The mode stated above could combine with mode 1 to 5, to achieve a better correction effect, which would not be described here.

It should be understood that the preferred embodiments for the present invention are described with lots of details, which could not be considered as the limit for the scope of patent protection. The scope of patent protection of the present invention is subject to the appended claims.

What is claimed is:

1. A method of correcting brightness of an electronic display that consists of a plurality of light-emitting components, comprising the steps of:

A. capturing an imaging picture of the display, said capturing step comprising the following steps:

A1. fixing photographic distance between the display and imaging units;

A2. fixing photographic brightness of the electronic display;

A3. focusing on the imaging units;

A4. fixing photographic parameters of the imaging units; and

A5. taking one or more photos of the electronic display by the imaging units to get the imaging picture of the display;

wherein steps A1 to A4 are not needed to be implemented in a particular order and can be implemented repeatedly or at the same time;

B. getting characteristic parameters of each of the light-emitting components in the imaging picture of the display, said getting step comprising the following steps:

B1. fixing locations of each of the light-emitting components at the imaging picture of the display;

B2. fixing an imaging region of each of the light-emitting components at the imaging picture of the display; and B3. getting a grey value of each pixel in the imaging region of each of the light-emitting components and calculate the characteristic parameters of each of the light-emitting components;

C. calculating a correction value of each of the light-emitting components with the characteristic parameters of each of the light-emitting components; and D. correcting the brightness of each of the light-emitting components with the correction value.

2. The correction method of claim 1, wherein in step A1, the photographic distance makes an angle between an photograph region of the display and the imaging unit less than 10°.

3. The correction method of claim 1, wherein in step A1, the photographic distance makes an angle between an photograph region of the display and the imaging unit less than 5°.

4. The correction method of claim 1, wherein in step A1, the photographic distance makes an angle between an photograph region of the display and the imaging unit less than 3°.

5. The correction method of claim 1, wherein in step A1, the photographic distance makes one light-emitting component correspond to several pixels.

6. The correction method of claim 1, wherein in step A1, the photographic distance makes one light-emitting component correspond to at least 25 pixels.

7. The correction method of claim 1, wherein in step A2, the photographic brightness makes saturated imaging pixels occupying not more than 50% of all of the imaging pixels.

8. The correction method of claim 1, wherein in step A2, the photographic brightness makes saturated imaging pixels occupying not more than 20% of all of the imaging pixels.

9. The correction method of claim 1, wherein in step A3 the method of focusing on the imaging unit is as follows:

A31. finding respective center points of two adjacent pixels;

A32. getting grey values of the respective center points;

A33. getting a grey value of a midpoint of the two adjacent pixels; and

A34. ensuring that the grey value of the midpoint is not larger than half of the grey values of any one of the respective center points.

10. The correction method of claim 1, wherein in step A4 the photographic parameters include:

an aperture value, which determines an amount of light admitted into sensors;

a filter;

a shutter value;

International Standards Organization (ISO); and a focal length.

11. The correction method of claim 1, wherein in step B1 the fixing of the locations of each of the light-emitting components at the imaging picture of the display includes steps as follows:

B11. getting a quantity of light-emitting components in a horizontal direction and a vertical direction of the imaging picture;

B12. finding the location of any light-emitting component of the imaging picture;

B13. searching a next light-emitting component with respect to the location found in the step B12; and B14. executing the step B13 iteratively until all of the light-emitting components of the imaging picture have been located.

12. The correction method of claim 11, wherein step B12 includes locating or finding the location of each of the light-emitting components of the imaging picture.

13. The correction method of claim 11, wherein step B12 includes locating one light-emitting component of the imaging picture; the light-emitting component being selected at random from an upper left, lower left, upper right, or lower left corner of the imaging picture.

14. The correction method of claim 11, wherein step B12 includes a process of judging whether the light-emitting component is damaged or missing if the light-emitting component is damaged or missing, an adjacent or a subsequent component needs to be determined.

15. The correction method of claim 1, wherein step B2 includes the steps below:

B21. fixing an imaging radius of each of the light-emitting components; and

B22. fixing the imaging region of each of the light-emitting components as a circle with a center of the imaging region being at the location of the light-emitting component and a radius of the imaging region being the imaging radius.

16. The correction method of claim 1, wherein step B3 includes the steps below:

B31. getting the grey value of each pixel in the imaging region of each of the light-emitting components, including red (R), green (G) and blue (B); and B32. calculating the grey value of each pixel in the imaging region of each of the light-emitting components with a preset algorithm, and getting the characteristic parameters of the light-emitting component.

17. The correction method of claim 1, wherein step C includes the steps as follows:

C1. calculating an actual brightness of each of the light-emitting components with the characteristic parameters; and C2. calculating the correction value of each of the light-emitting component using the actual brightness.

18. A method of correcting brightness of an electronic display that consists of a plurality of light-emitting components, comprising:

A01. fixing a distance between the electronic display and imaging units;

fixing a brightness of the electronic display by photographing;

focusing on the imaging units;

fixing photograph parameters of the imaging units;

wherein the aforesaid steps are not needed to be implemented in a particular order, and can be implemented repeatedly or at the same time; and taking one or more photos of the electronic display by the imaging units to get an imaging picture of the display;

B01. fixing a quantity of the light-emitting components in a horizontal direction and a vertical direction of the imaging picture;

finding a light-emitting component as a first light-emitting component in an upper left, lower left, upper right, or lower left corner of the imaging picture;

making the first light-emitting component of the electronic display as a starting point and executing a search iteratively until all of the light-emitting components have been located; and determining an imaging region of each of the light-emitting components, and getting a grey value of each pixel in the imaging region of each of the light-emitting components, and then calculating characteristic parameters of each of the light-emitting components;

C01. calculating a correction value of each of the light-emitting components with the characteristic parameters; and D01. correcting the brightness of the display with the correction value.

19. A method of correcting brightness of an electronic display that contains of a plurality of light-emitting components, comprising:

A02. fixing a distance between the electronic display and imaging units;

fixing a brightness of the electronic display;

focusing on the imaging units;

fixing photograph parameters of the imaging units;

wherein the aforesaid steps are not needed to be implemented in a particular order, and can be implemented repeatedly or at the same time; and taking one or more photos of the electronic display by the imaging units to get an imaging picture of the display;

B02. fixing a quantity of the light-emitting components in a horizontal direction and a vertical direction of the imaging picture;

finding a light-emitting component as a first light-emitting component in an upper left, lower left, upper right, or lower left corner of the imaging picture;

Determining an adjacent or a subsequent component if any of the light-emitting components at the upper left, lower left, upper right, or lower left corner of the imaging picture is damaged or missing;

making one of the light-emitting components as a starting point, and then executing a search iteratively until all of the light-emitting components have been located;

determining an imaging region of each of the light-emitting components, and getting a grey value of each pixel in the imaging region of each of the light-emitting components, and then calculating characteristic parameters of each of the light-emitting components;

C02. calculating a correction value of each of the light-emitting components with the characteristic parameters; and D02. correcting the brightness of the display with the correction value.

* * * * *